US011786912B1

(12) United States Patent
Smith

(10) Patent No.: US 11,786,912 B1
(45) Date of Patent: Oct. 17, 2023

(54) ORE WASHER

(71) Applicant: Chad R. Smith, Redding, CA (US)

(72) Inventor: Chad R. Smith, Redding, CA (US)

( * ) Notice: Subject to any disclaimer, the term of this patent is extended or adjusted under 35 U.S.C. 154(b) by 0 days.

(21) Appl. No.: 18/083,027

(22) Filed: Dec. 16, 2022

Related U.S. Application Data

(60) Provisional application No. 63/290,857, filed on Dec. 17, 2021.

(51) Int. Cl.
*B03B 5/56* (2006.01)

(52) U.S. Cl.
CPC ..... *B03B 5/56* (2013.01)

(58) Field of Classification Search
CPC ..... B03B 5/48; B03B 5/56
USPC ..... 209/273, 417, 420
See application file for complete search history.

(56) References Cited

U.S. PATENT DOCUMENTS

| | | | | | |
|---|---|---|---|---|---|
| 798,841 | A * | 9/1905 | Taylor | B07B 1/46 | 209/365.2 |
| 1,362,896 | A * | 12/1920 | Rieck | B03B 5/28 | 209/173 |
| 2,325,809 | A * | 8/1943 | Stephansko | B65F 7/00 | 220/521 |
| 2,726,833 | A * | 12/1955 | Burgh | B65F 1/1421 | 211/85 |
| 2,964,188 | A | 12/1960 | Evans et al. | | |
| 4,148,725 | A | 4/1979 | Haight | | |
| 5,275,294 | A | 1/1994 | Krenzler | | |
| 5,667,076 | A | 9/1997 | Rosman | | |
| 5,788,293 | A | 8/1998 | Krenzler | | |
| 6,755,207 | B1 * | 6/2004 | Curtis | F04F 5/20 | 137/205 |
| 7,134,556 | B1 | 11/2006 | McCauley | | |
| 8,646,614 | B2 * | 2/2014 | Peterson | B03B 5/02 | 209/233 |
| 9,662,662 | B1 | 5/2017 | Weaver et al. | | |
| 9,676,002 | B2 | 6/2017 | Guillemin | | |
| 10,010,910 | B1 * | 7/2018 | Stover | B07B 1/02 | |
| 10,384,233 | B2 | 8/2019 | Martori | | |
| 2016/0192804 | A1 * | 7/2016 | Mesmer | A47J 27/04 | 99/410 |
| 2021/0114041 | A1 * | 4/2021 | Whitman | B03B 9/00 | |

FOREIGN PATENT DOCUMENTS

| | | | | |
|---|---|---|---|---|
| CA | 2775576 | A1 * | 11/2012 | B03B 5/02 |
| DE | 102020131104 | A1 * | 5/2022 | |
| JP | H08299711 | A * | 11/1996 | |
| WO | WO-2008036785 | A2 * | 3/2008 | A47J 36/20 |

* cited by examiner

*Primary Examiner* — Terrell H Matthews
(74) *Attorney, Agent, or Firm* — CRAMER PATENT & DESIGN, PLLC; Aaron R. Cramer

(57) ABSTRACT

An ore washer is a cylindrical sieve that is slightly smaller than a standard five gallon bucket. The sides and bottom of the cylinder are provided with oblong openings that allow for smaller pieces of rock and dirt to pass. The top of the sieve is provided with a wooden ring and an upright handle that spans side to side. The invention fits within a standard plastic five gallon pail. During use, raw ore is placed in the device, and the device is placed in a pail of water. The handle is swirled back and forth to wash small particles out of the sieve, while larger material and rocks remain behind. This large material is then discarded, and the captured material in the plastic pail is further refined by panning to capture any gold.

1 Claim, 5 Drawing Sheets

ORE WASHER

RELATED APPLICATIONS

The present invention was first described in and is a continuation-in-part of U.S. Provisional Patent Application No. 63/290,857 filed on Dec. 17, 2021, the entire disclosures of which are incorporated herein by reference.

FIELD OF THE INVENTION

The present invention relates generally to a device for washing a collected number of ore and method of use thereof.

BACKGROUND OF THE INVENTION

The separation of ore particles from earth or "paydirt" is a long standing and time-honored tradition. One such effort involves the processing of gold-bearing materials from sediment. Small operations as well as testing often relies on the panning process. However, before panning can occur, the larger material and rocks in the paydirt must be removed first. This is commonly performed by a piece of equipment called a classifier. Conventional classifiers are often large and expensive.

Even so, such classifiers do not always work efficiently. They may take too long to perform the process. They may also not effectively remove all of the gold-bearing material causing them to be discarded with the larger material. Finally, gold-bearing material may be washed away before it makes it to the panning process. Accordingly, there exists a need for a means by which a gold classifier can be developed with addresses the needs as outlined above. The use of the ore washer provides a means to classify gold ore in a manner which is quick, easy, and effective.

SUMMARY OF THE INVENTION

To achieve the above and other objectives, the present invention provides for an ore washer, having a strainer having a strainer interior and a strainer body, a plurality of ore-containing material fed into the strainer interior of the strainer, a receptacle having an interior receiving the strainer removably inserted within the receptacle interior, and a plurality of water introduced into the strainer interior and the receptacle interior. The strainer may include a torus-shaped strainer rim having an upper strainer rim and a lower strainer rim that rests on top of a receptacle rim.

Located on diametrically opposing sides of the torus-shaped strainer rim may be a pair of strainer rim apertures. The strainer body may be attached to or is integral with a center diameter of the upper strainer rim and depends downwardly therefrom. The receptacle may include a cylindrical body with a closed bottom and an open top surrounded by the receptacle rim. The receptacle interior may be bound by a plurality of inner surfaces of the receptacle body and a plane crossing the receptacle rim. The receptacle may be a 5 gallon receptacle. A receptacle handle may be hingedly attached to an outer surface of a side wall of the receptacle body. A strainer handle stop may be located adjacent a terminal end of each distal portion of a strainer handle. The strainer handle stop may be a cotter pin. A stop flange and a spring may be anchored in place to the stop flange and an interior of the strainer handle.

The strainer handle may include a pair of retractable handle stops at the lower portion of each side of the receptacle. The strainer handle may be generally a U-shaped member having a curvilinear center portion and a pair of distal portions. The strainer handle has a ¾ in. internal diameter. The strainer handle may be made of galvanized steel tubing. The strainer handle may be 18 ins. long. Water pressure from the water may be strong enough to filter a plurality of non-ore-bearing material of the ore-containing material through the strainer and into the receptacle interior.

Water pressure from the water may be strong enough to provide a moving force on the strainer to filter the non-ore-bearing material of the ore-containing material through the strainer and into the receptacle interior. The strainer may remove a plurality of retained gold-bearing ore from the receptacle. The retained gold-bearing ore may be flushed away from the strainer and collected in the receptacle.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
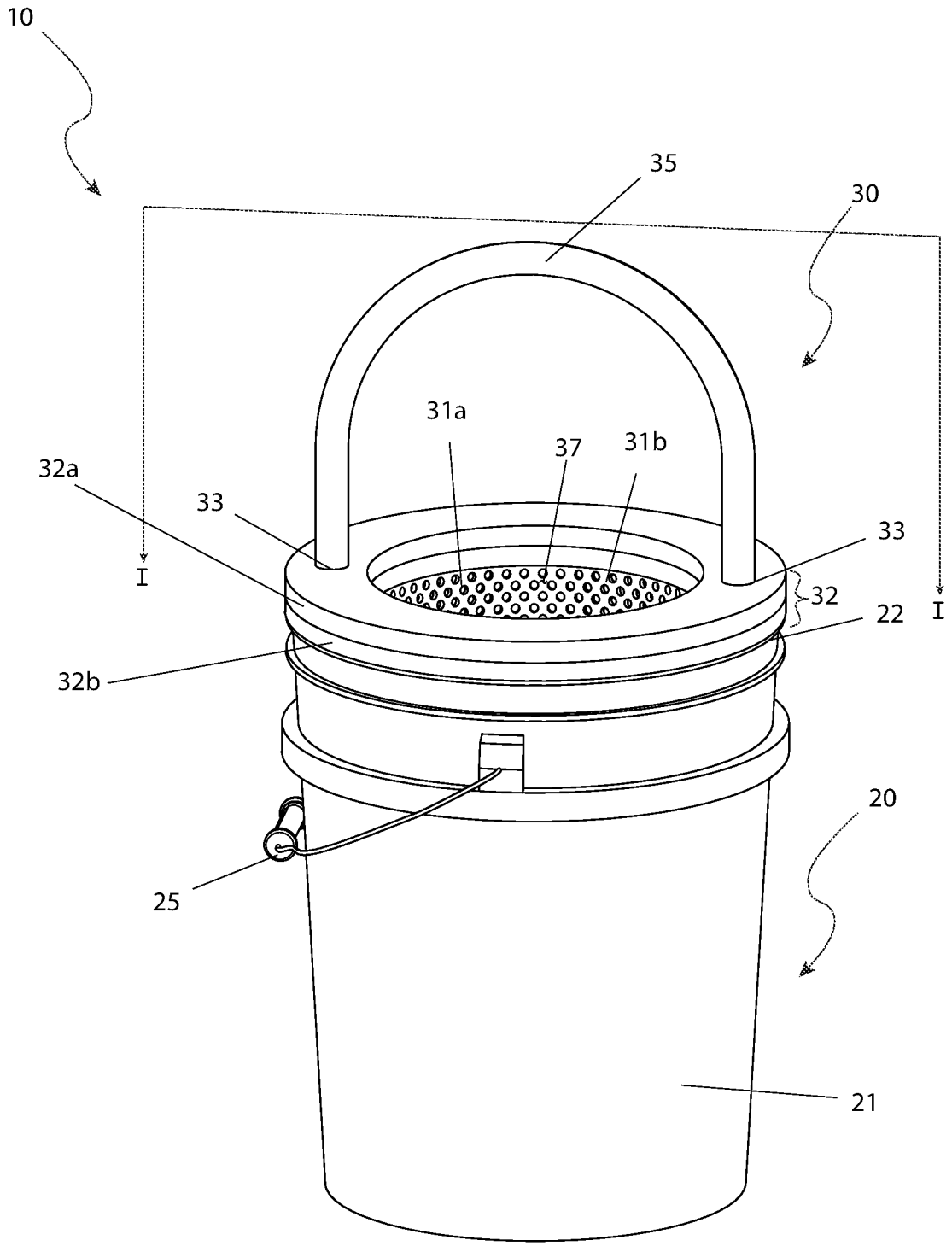
FIG. 1 is a perspective view of an ore washer, showing a strainer inserted into a receptacle, according to the preferred embodiment of the present invention.

10 ore washer
20 receptacle
21 receptacle body
22 receptacle rim
25 receptacle handle
27 receptacle interior
30 strainer
31*a* strainer body
31*b* strainer body aperture
32 strainer rim
32*a* upper strainer rim
32*b* lower strainer rim
33 strainer rim aperture
35 strainer handle
35*a* strainer handle travel path "a"
36 strainer handle stop
37 strainer interior
38 pinch weld
39 strainer bottom rim
39*a* upper flanged connection
40 ore-containing material
45 handle stop
45*a* handle interior
50 handle opening

55 stop travel path "b"
60 stop flange
65 spring

1. Description of the Invention

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

Figure 5:
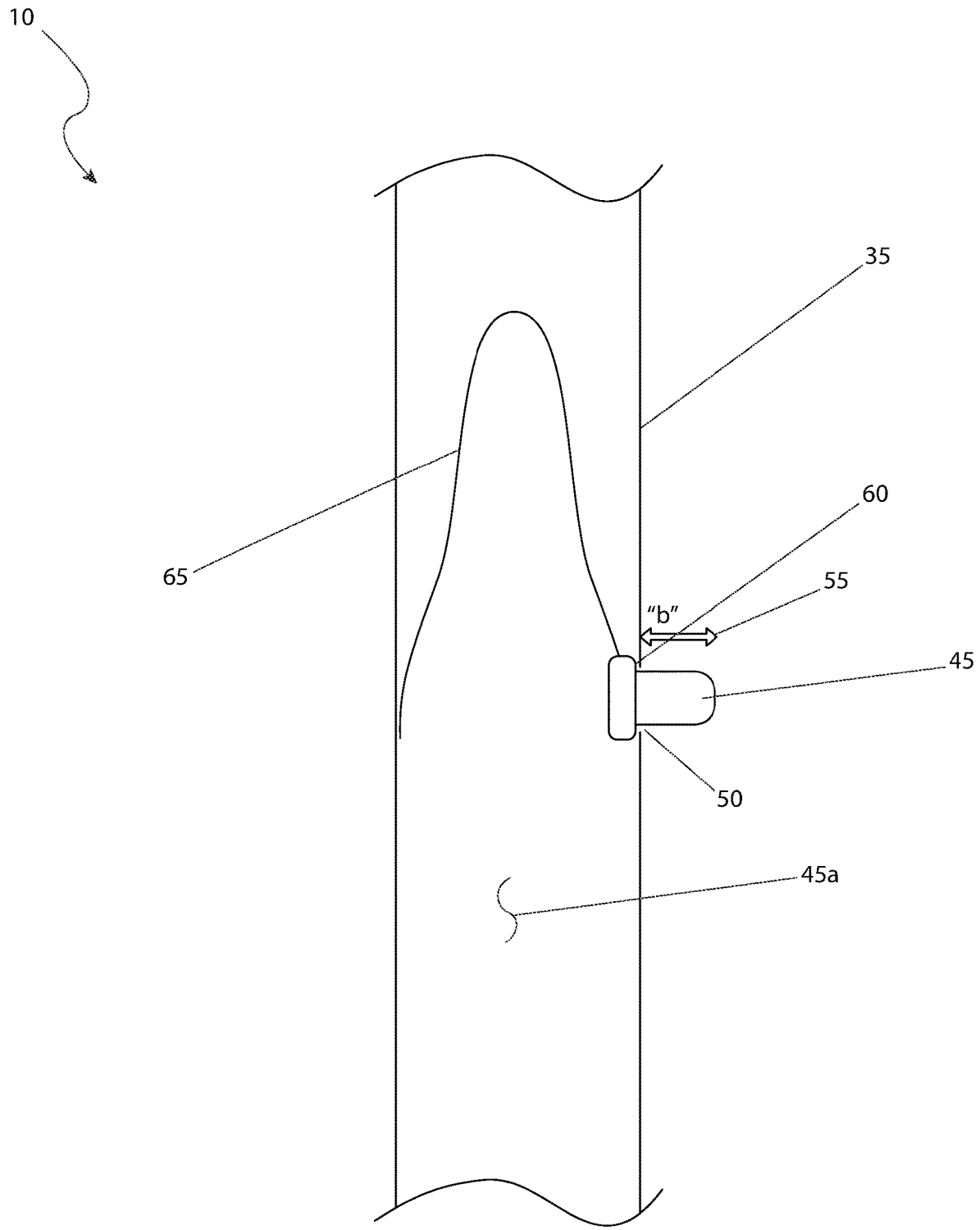
FIG. 5 is a cross-sectional view of the strainer handle as used with ore washer, as seen along a Line II-II, as seen in FIG. 3, according to the preferred embodiment of the present invention.

Referring now to FIGS. 1 and 5, an ore washer 10 is depicted as having a strainer 30 removably inserted within a receptacle interior 27 of a receptacle 20. Ore-containing material 40 that has been previously gathered is fed into a strainer interior 37 of the strainer 30. The strainer 30 may be already inserted into the receptacle 20 or maybe done so thereafter. Water is introduced into the strainer interior 37 and/or the receptacle interior 27. The water pressure is strong enough to filter any non-ore-bearing material of the ore-containing material 40 through the strainer 30 and into the receptacle interior 27, or alternately, a moving force on the strainer 30 may achieve similar results. The strainer 20, with the retained gold-bearing ore can thus be removed from the receptacle 20. Alternately, depending on the size and shape of the strainer 30, the gold-bearing ore can be flushed away from the strainer 30 and collect in the receptacle 20.

Figure 2:
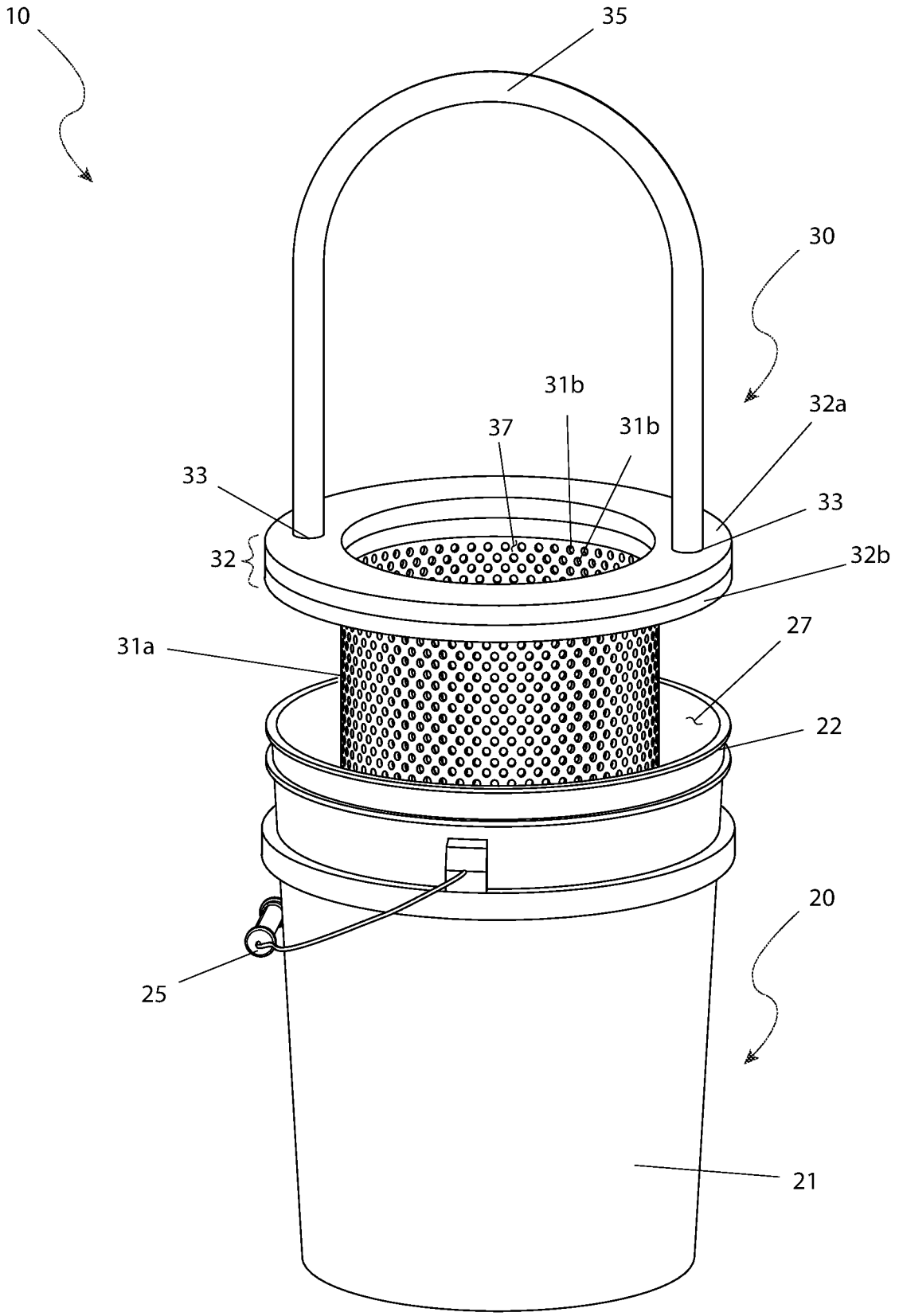
FIG. 2 is an end view of the ore washer, where the strainer is partially removed from the receptacle, according to the preferred embodiment of the present invention.

Referring now more closely to FIGS. 1 and 2, the receptacle 20 may resemble and have the capacity of a five-gallon (5 Gal) bucket, wherein a receptacle body 21 is cylindrical with a closed bottom and an open top surrounded by a receptacle rim 22. A receptacle handle 25 is hingedly attached to an outer surface of a side wall of the receptacle body 21. The receptacle interior 27 is bound by inner surfaces of the receptacle body 21 and a plane crossing the top of the receptacle rim 22.

Figure 3:
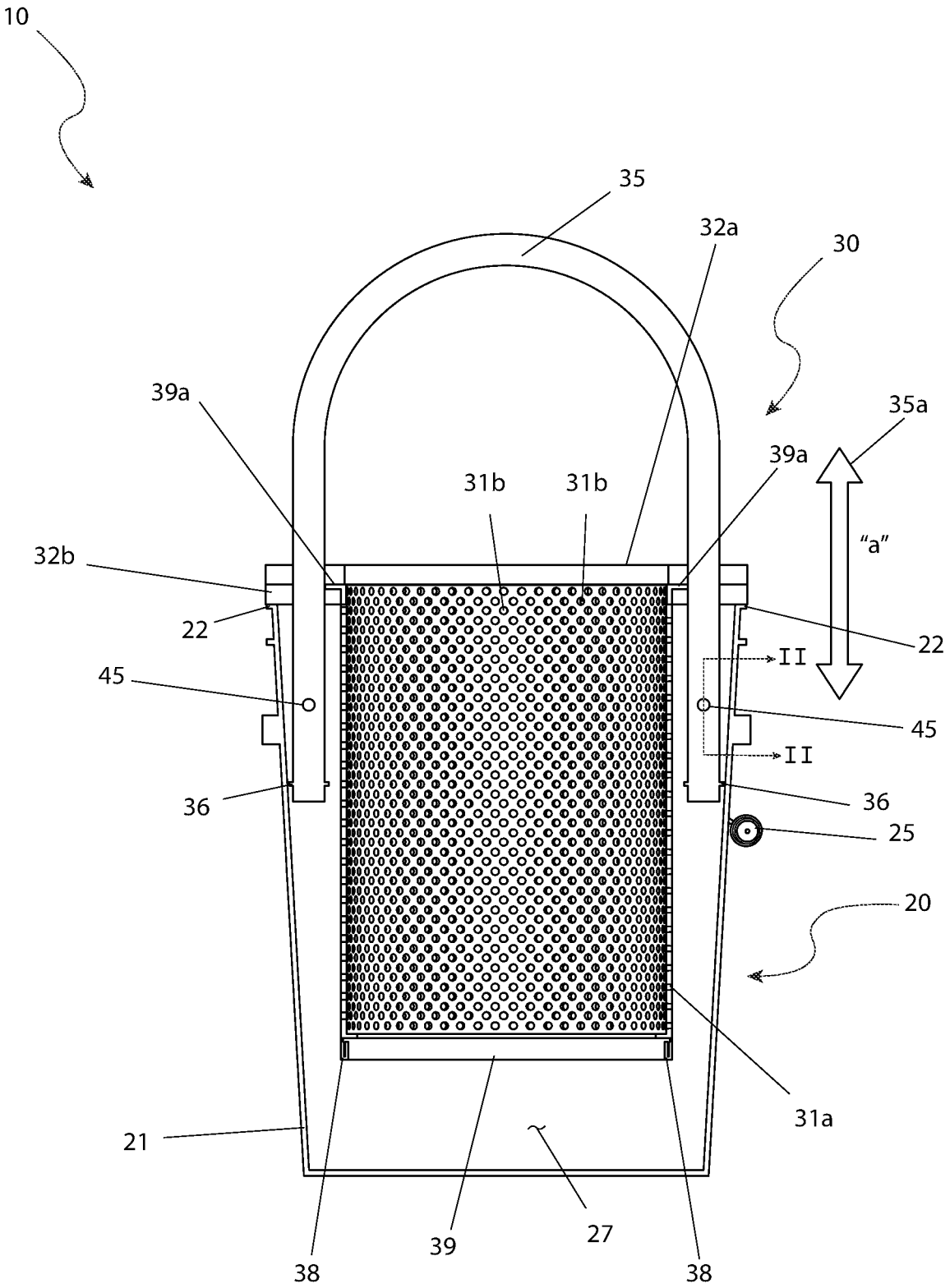
FIG. 3 is a sectional view along the Line I-I of FIG. 1, according to the preferred embodiment of the present invention.
Figure 4:
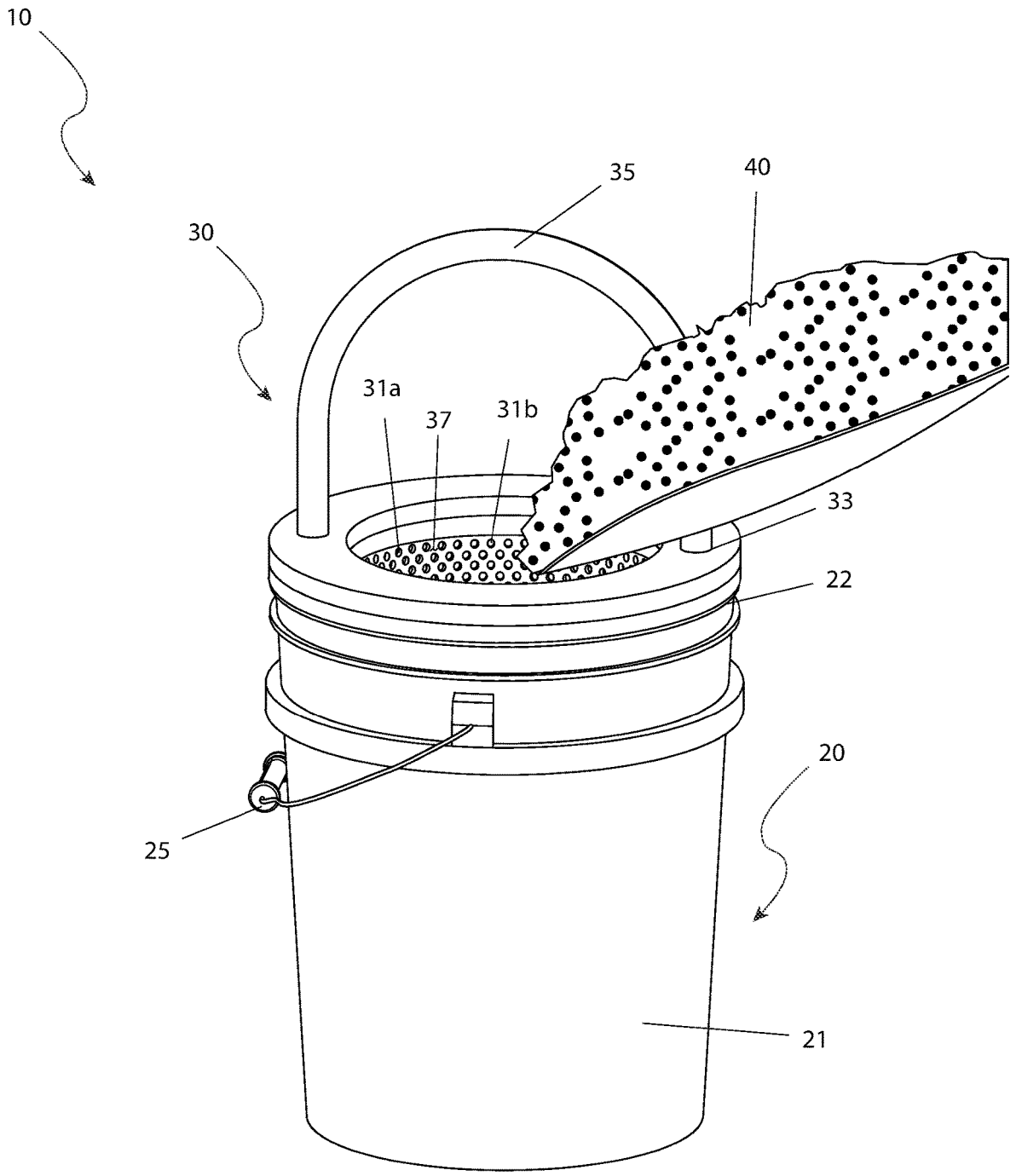
FIG. 4 is an environmental perspective view of the ore washer prepared to receive an amount of ore-containing material, according to the preferred embodiment of the present invention.

The strainer 30 includes a torus-shaped strainer rim 32, consisting of an upper strainer rim 32*a*, and a lower strainer rim 32*b*, that has a diameter capable of resting on top of the receptacle rim 22. Located on diametrically opposing sides of the strainer rim 32 are a pair of strainer rim apertures 33. A strainer handle 35 is generally a U-shaped member, having a curvilinear center portion and two (2) distal portions. It is envisioned that the strainer handle 35 would be made of three-quarter inch (¾ in.) internal diameter (I.D.) galvanized steel tubing and approximately eighteen inches (18 in.) tall. Located adjacent a terminal end of each distal portion of the strainer handle 35 is a strainer handle stop 36, such as a cotter pin. The strainer handle 35 is movably positionable relative to the strainer rim 32, along a strainer handle 35 travel path "a" 35*a*, (as seen in FIG. 3) but retained thereto. The strainer handle 35 is also provided with two (2) retractable handle stops 45 at the lower portion of each side. Further description on the operation and functionality of the handle stops 45 will be provided herein below. The curvilinear center portion of the strainer handle resides above the strainer rim 32 and the two (2) distal portions of the strainer handle 35 slidably engage a respective strainer rim aperture 33. The strainer handle stops 36 resist full removal of the two (2) distal portions of the strainer handle 35 out of the strainer rim apertures 33. The strainer rim 32 in certain embodiments can be fabricated out of wood material. The strainer handle 35 in certain embodiments may be manufactured out of stainless steel. The overall dimensions of the ore washer 10, are approximately twelve and a half inches (12½ in.) in diameter and eleven and a half inches (11½") in overall height, excluding the strainer handle 35.

A strainer body 31*a* is attached to or integral with a center diameter of the strainer rim 32 and depends downwardly therefrom. The strainer body 31*a* is typically cylindrical with a bottom, sides, and an open top to define a strainer interior 37. The height of the strainer body 31*a* is such that there is a gap between the facing surfaces of the strainer body 31*a* and receptacle body 21. The bottom of the strainer body 31 is affixed to the bottom via a pinch weld 38 thus forming a strainer bottom rim 39. The top of the strainer body 31 is flanged over and "sandwiched" between the upper strainer rim 32*a* and the lower strainer rim 32*b* forming an upper flanged connection 39*a*.

Located equidistantly spaced or randomly-spaced about the entire strainer body 31*a* is a plurality of strainer body apertures 31*b*, which in a preferred embodiment, are three-sixteenths of an inch (3/16 in.) in diameter, and are arranged in a staggered row format on one-quarter inch (¼ in.) centers. The shapes and sizes of the strainer body apertures 31*b* can be variable depending on the desired collection of gold-bearing ore from the ore-containing material 40. The strainer body 31*a* in certain embodiments may be manufactured out of stainless steel of twenty-two gauge (22 ga.).

Referring now more closely to FIG. 5, the strainer handle 35, along with a strainer handle interior 45*a*, formed by the hollow nature of the strainer handle 35 is shown. The retractable handle stop 45 is provided in a handle opening 50. The retractable handle stop 45 moves along a stop travel path "b" 55. Further motion outward is restricted by a stop flange 60. The retractable handle stop 45 is held outward by a spring 65. The spring 65 is anchored in place to the stop flange 60, and the interior of the strainer handle 35. The above-mentioned retractable handle stop 45, and associated components, is provided on both sides of the strainer handle 35, as shown in FIG. 1.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An ore washer, comprising:

a strainer having a strainer interior and a strainer body;

a plurality of ore-containing material fed into the strainer interior of the strainer;

a receptacle having an interior receiving the strainer removably inserted within the receptacle interior;

a receptacle handle hingedly attached to an outer surface of a side wall of the receptacle body;

a strainer handle stop located adjacent a terminal end of each distal portion of a strainer handle;

a stop flange and a spring that is anchored in place to the stop flange and an interior of the strainer handle;

a plurality of water introduced into the strainer interior and the receptacle interior and, wherein the strainer includes a torus-shaped strainer rim having an upper strainer rim and a lower strainer rim that rests on top of a receptacle rim;

wherein located on diametrically opposing sides of the torus-shaped strainer rim are a pair of strainer rim apertures;

wherein the strainer body is attached to or is integral with a center diameter of the upper strainer rim and depends downwardly therefrom;

wherein the receptacle includes a cylindrical body with a closed bottom and an open top surrounded by the receptacle rim;

wherein the receptacle interior is bound by a plurality of inner surfaces of the receptacle body and a plane crossing the receptacle rim;

wherein the strainer handle includes a pair of retractable handle stops at the lower portion of each side of the receptacle;

wherein the strainer handle is generally a U-shaped member having a curvilinear center portion and a pair of distal portions;

wherein water pressure from the water is suitable to filter a plurality of non-ore-bearing material of the ore-containing material through the strainer and into the receptacle interior;

wherein water pressure from the water is suitable to provide a moving force on the strainer to filter the non-ore-bearing material of the ore-containing material through the strainer and into the receptacle interior;

wherein the strainer removes a plurality of retained gold-bearing ore from the receptacle; and, wherein the retained gold-bearing ore is flushed away from the strainer and collected in the receptacle.

* * * * *